United States Patent [19]

Dahlgren et al.

[11] Patent Number: 4,567,824

[45] Date of Patent: Feb. 4, 1986

[54] PLANETARY CONVEYOR SYSTEM

[75] Inventors: Harold P. Dahlgren, Dallas; John W. Gardiner, Bedford; Jesse L. Lowdermilk, Fort Worth, all of Tex.

[73] Assignee: Dahlgren Manufacturing Company, Inc., Dallas, Tex.

[21] Appl. No.: 583,488

[22] Filed: Feb. 29, 1984

Related U.S. Application Data

[63] Continuation of Ser. No. 295,017, Aug. 21, 1981, abandoned.

[30] Foreign Application Priority Data

Sep. 12, 1980 [WO] PCT Int'l Appl. ..... WO80/01209

[51] Int. Cl.[4] ..... B41F 5/01; B41F 13/12

[52] U.S. Cl. ..... 101/183; 101/232; 101/219; 198/812

[58] Field of Search ..... 198/812; 101/232

[56] References Cited

U.S. PATENT DOCUMENTS

| | | | |
|---|---|---|---|
| 3,103,125 | 9/1963 | Dntro et al. | 474/900 |
| 3,562,427 | 2/1971 | Imanishi et al. | 474/900 |
| 3,602,650 | 8/1971 | Ban | 226/178 |
| 3,664,261 | 5/1972 | Dahlgren | 101/181 |
| 3,739,969 | 6/1973 | Warren | 226/178 |
| 3,888,217 | 6/1975 | Hissevich | 474/900 |
| 3,978,977 | 9/1976 | Michelbrink et al. | 198/816 |
| 4,081,723 | 3/1978 | Vetter et al. | 101/181 |
| 4,129,238 | 12/1978 | Herd | 101/181 |
| 4,210,237 | 7/1980 | Gram | 198/812 |
| 4,243,925 | 1/1981 | Gneuchtel | 101/181 |

FOREIGN PATENT DOCUMENTS

| | | | |
|---|---|---|---|
| 3131392 | 2/1983 | Fed. Rep. of Germany | 101/183 |
| 22286 | 2/1977 | Japan | 198/816 |
| 2083449 | 2/1982 | United Kingdom | 101/183 |
| 220221 | 9/1968 | U.S.S.R. | 101/183 |
| 375231 | 6/1973 | U.S.S.R. | 198/816 |

*Primary Examiner*—William Pieprz

*Attorney, Agent, or Firm*—Gerald G. Crutsinger; John F. Booth; Monty L. Ross

[57] ABSTRACT

An automatic sheet register control system for a printing press comprising: photocells (81–85) sensing the position of a sheet (5) relative to printing cylinder (48U); and a computer (86–89) to generate signals to actuators (**75*a*, 75*b*) to adjust the length of bands (16*a*, 16*b*) which carry the sheets (5) to establish and control register of the sheet (5) relative to the printing cylinder (48U**).

4 Claims, 17 Drawing Figures

PLANETARY CONVEYOR SYSTEM

This is a continuation, of application Ser. No. 295,017 filed Aug. 21, 1981 now abandoned.

BACKGROUND OF INVENTION

This invention relates to improvements in conveyor systems of the type disclosed in Dahlgren U.S. Pat. No. 3,644,261, entitled "Straight Feed Press" and Dahlgren U.S. Pat. No. 3,847,079, entitled "Method of Printing Sheets". The disclosure of each of the aforementioned patents is incorporated herein by reference in its entirety for all purposes.

The aforementioned patents disclosed a sheet-fed printing press which incorporated a straight through and continuous sheet transfer principle, similar to the feeding style of a web-fed printing press, whereby sheets were grasped by gripper bars carried by flexible steel tapes or bands which extended around drive wheels for moving the sheets through a plurality of printing towers.

In printing it is critical that registration of the sheet to each printing cylinder be precisely maintained so that dots on each sheet precisely correspond to a corresponding dot on the other sheets. In single color printing, it is also critical that registration be maintained because sheets are often passed through a printing press more than one time to apply additional colors.

In the conveyor system described in the aforementioned patents, flexible steel tapes were driven by circular wheels mounted adjacent opposite ends of the printing press, with the band having indexing pins mounted therein. This created two major problems which tended to hamper marketability of the system.

First, the expansion of various materials are dependent upon the temperature, although for design purposes constant mean values are usually employed for design purposes. If lengths, areas, and volumes are at a standard temperature, the approximate change in dimensions of the material will be considered to be a function of the change in temperature. At best, such design criteria provides only approximate dimensions and resultant inaccuracy in speed and location of parts. Even though all components of the printing press may be constructed of materials having an identical co-efficient of thermal expansion, the dimensions of various components of the system may change non-uniformly which results in further variation of the speed and location of various parts of the system which is detrimental to registration of the press.

Second, even if thermal expansion is ignored, it is virtually impossible to construct and drive through circular members to maintain absolute registration. The Greek letter $\pi$ pronounced "pi", is the ratio of the circumference of any circle to its diameter and stands for the number by which the diameter of a circle must be multiplied to obtain the circumference. Thus, the circumference of a circle is equal to $\pi$ times the diameter of the circle.

The number $\pi$ cannot be exactly expressed as a decimal. The common values used to express $\pi$ include 22 divided by 7, 3.14, 3.1416, and 3,14159. Rounded off to twenty decimal places, $\pi$ is approximately equal to 3.14159265358979323846.

Thus, the technical problem exists of obtaining absolute accuracy in manufacturing circular members and of maintaining near absolute accuracy of components and replacement parts under varying conditions of temperature, speed, acceleration and other operating conditions.

Various devices have been devised heretofore for adjusting the tension in a web and the distance a web travels between adjacent printing cylinders in an effort to maintain registration in web-fed printing presses. However, such devices are not readily adaptable for sheet-fed printing presses of the type disclosed in the aforementioned patents because the web is generally routed along a serpentine path to compensate for errors in registration between colors.

SUMMARY OF THE INVENTION

The method and apparatus disclosed herein relates to an improved conveyor system and register computer to provide automatic register between an endless conveyor surface and a printing cylinder.

The method of maintaining endless surfaces on two members, at least one of which is circular, in a precisely synchronized relationship, in rolling relation with a surface on the other member, comprises the steps of: moving the surface of the circular member in rolling relation with the surface of the other member; periodically comparing the position of a reference point on the circular member with a reference point on the other member to determine the spacing between the reference points; and adjusting the length of one of the endless surfaces to reduce spacing between the points on the respective members as they move in rolling relationship. The improved method is accomplished by adjusting the length of elastic flexible bands carrying gripper bars through the printing press to maintain the gripper bars and sheets carried by the gripper bars in synchronized relationship with the printing cylinders.

The apparatus for accomplishing this method includes a pair of endless flexible bands driven by circular wheels, and gripper bars extending between the bands and spaced longitudinally thereof, for carrying sheets. Each of the bands extends around and is driven by a drive wheel. The band is maintained in tension by at least one idler wheel for causing a portion of the band to extend along a precisely defined path. Reference pins are attached to the drive wheel and to each band of the conveyor so that the reference pins will be positioned in a known relationship relative to each other when the conveyor and printing cylinders in a press are registered. Sensors are positioned to generate signals when each of the reference pins move adjacent thereto. The signals are compared and delivered through a computer to a an actuator for adjusting spacing between the drive wheel and the idler wheel to adjust the length of the band. Thus, the length of the path, along which the reference pin carried by the conveyor, is varied to maintain registration between the reference pin on the conveyor and the reference pin on the drive wheel.

A primary object of the invention is to provide an endless conveyor and another endless member, at least one of which is circular, in a moving registered relationship even though the circumference of the circular member varies under normal operating conditions.

Another object of the invention is to provide a conveyor for a sheet-fed printing press wherein the length of the conveyor is capable of adjustment for purposes of registering the conveyor with printing cylinders to provide a sheet-fed press in which the sheet is continuously gripped by a single set of grippers from the time the sheet enters the press at the feeder until it reaches the delivery station.

A further object of the invention is to provide a conveyor for a sheet-fed printing press, the length of the conveyor being adjustable for maintaining registry between sheets moving at a constant speed by the conveyor along a path which is adjustable in length.

Other and further objects of the invention will become apparent upon referring to the detailed description hereinafter following and to the drawings annexed hereto.

DESCRIPTION OF THE DRAWINGS

The accompanying drawings illustrate a preferred embodiment of the invention and are provided so that the invention may be better and more fully understood, in which.

Numeral references are employed to designate like parts throughout the various figures of the drawing.

DESCRIPTION OF A PREFERRED EMBODIMENT

Figure 2:
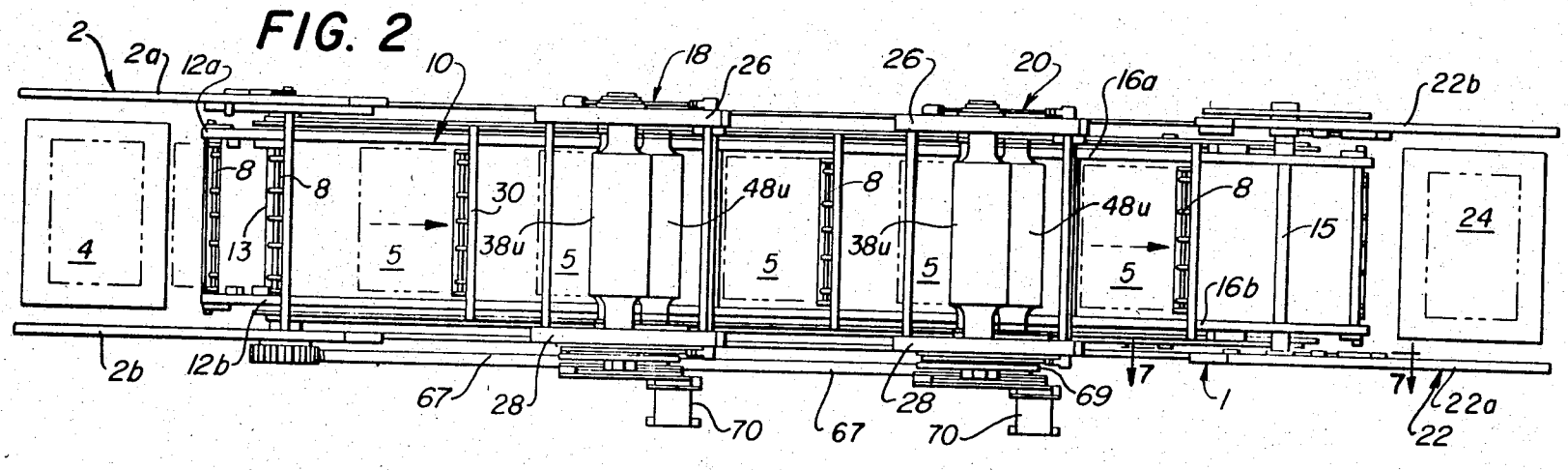
FIG. 2 is a top plan view of the printing press having inkers and dampeners removed therefrom.
Figure 1:
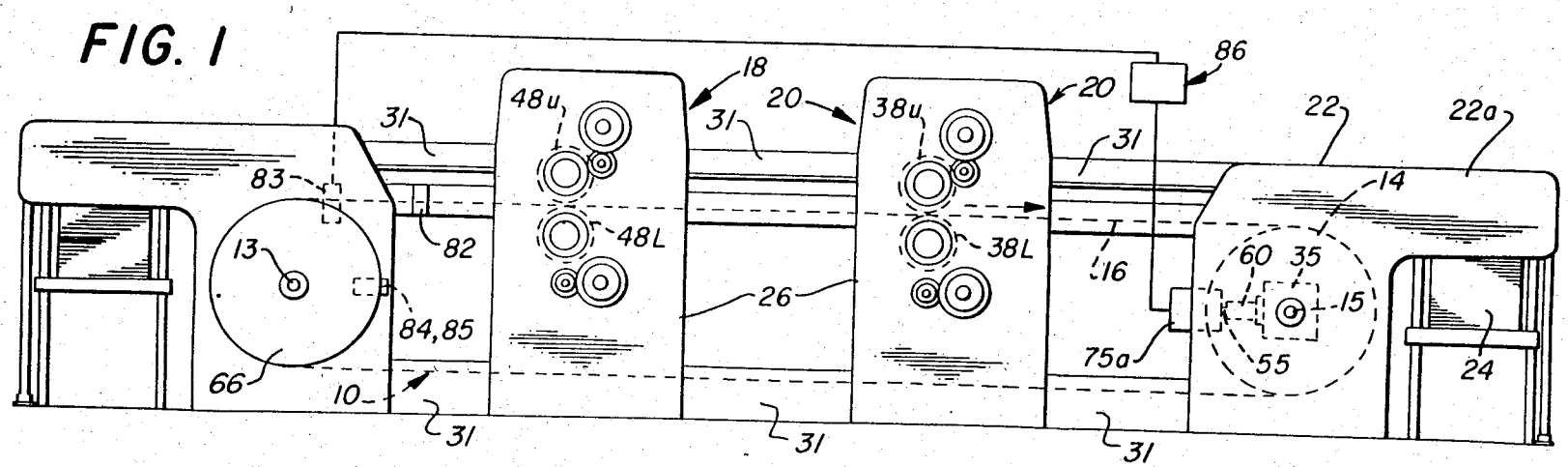
FIG. 1 is a side elevational view of the operator side of the printing press.
Figure 3:
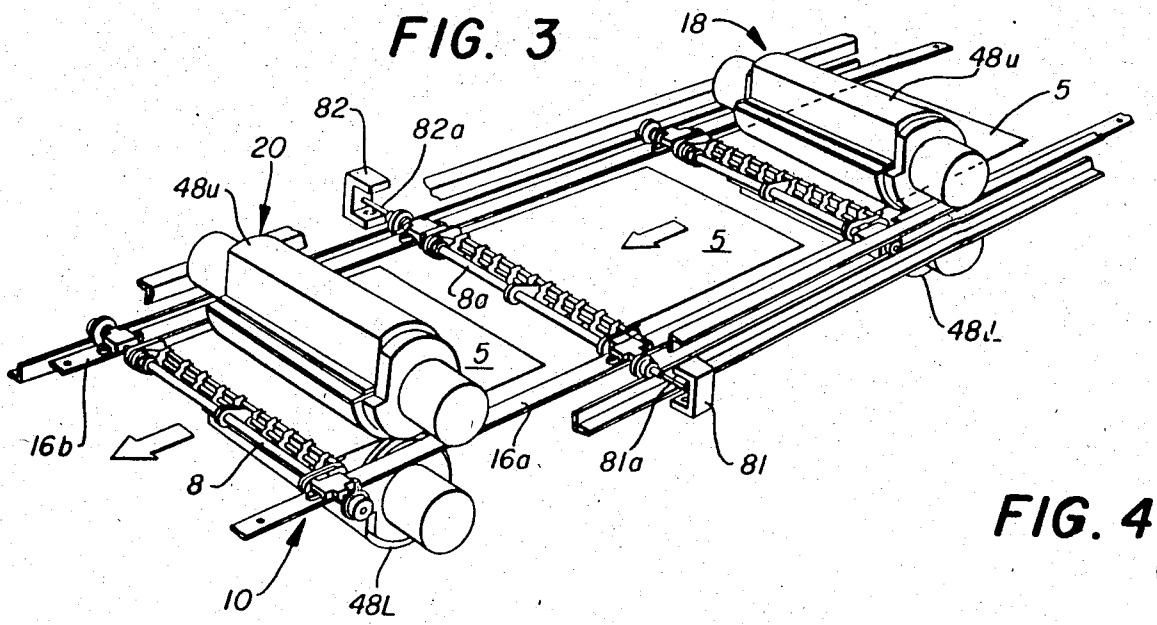
FIG. 3 is a diagrammatic view illustrating the relationship of the sheet conveyor to printing cylinders.

Referring to FIGS. 1, 2 and 3 of the drawing, the numeral 1 generally designates a sheet-fed, multi-color, perfecting, lithographic printing press of the type disclosed in U.S. Pat. No. 3,847,079.

A feeder mechanism 2 delivers sheets of unprinted paper from a stack 4 to a switch gripper 6. The swing gripper 6 accelerates individual sheets 5 to the velocity of gripper bars 8 carried by a sheet transfer mechanism 10. The sheet transfer mechanism 10 comprises drive wheels 12*a* and 12*b* adjacent the feeder end of the press and idler wheels 14*a* and 14*b* adjacent the delivery end of the printing press. The wheels carry tapes or bands 16*a* and 16*b*, having gripper bars 8 mounted therebetween for moving individual sheets 5 through the printing press.

In the illustrated embodiment, a pair of printing towers 18 and 20 are provided to give the press a multicolor, perfecting printing capability. It should be appreciated that any number of printing towers may be employed for printing additonal colors or for coating sheets.

Individual sheets 5 are gripped by a delivery mechanism 22 as they are released by gripper bars 8 to form a stack 24 of printed sheets.

As best illustrated in FIG. 2, each printing tower 18 and 20 has a side frame 26 on the operator side of the press and a side frame 28 on the drive side of the press, joined by tie bars 30, to form a strong rigid frame structure upon which various components of the press are mounted. Feeder 2 and delivery 22 have side frames 2*a* and 22*a* on the operator side of the press and side frames 2*b* and 22*b* on the drive side of the press, respectively. The plates 31 join the side frames of feeder 2, printing tower 18, printing tower 20 and deliver 22 adjacent opposite sides of the printing press.

Each printing tower 18 and 20 is provided with an upper plate cylinder 38U and a lower plate cylinder 38L, an upper blanket cylinder 48U and a lower blanket cylinder 48L. It will be readily apparent that the upper and lower blanket cylinders 48U and 48L serve the dual function of a printing cylinder and a back-up cylinder and engage opposite sides of sheets 5, as best illustrated in FIG. 3, carried through the printing press by gripper bars 8 extending between bands 16*a* and 16*b*.

Each blanket cylinder 48U and 48L has a gap 49 formed therein to permit movement of gripper bars 8 therebetween.

It will be appreciated that each plate cylinder 38U and 38L is equipped with plate clamps to facilitate securing a printing plate thereto and that each blanket cylinder 48U and 48L is equipped with clamps for securing a blanket thereto.

In the illustrated embodiment, inking systems and dampening systems for applying ink and dampening fluid to lithographic printing plates are not illustrated. In addition, circumferential and lateral register adjustments for the various cylinders are not illustrated. However, the provision of other and further conventional components is deemed to be within the skill of a press manufacturer.

Further, although the conveyor system is illustrated in combination with a lithographic printing press, the conveyor may be employed in any rotary printing system, for example, in which an image is applied by a printing plate to a blanket cylinder and offset onto a sheet, or, printed directly from a planographic printing plate, letter press, relief or intaglio pringing plate or printing cylinder to a sheet. Further, the conveyor system may be employed with a mechanism for performing operations other than printing, for example, cutting, folding, slitting, punching, reading indicia and the like.

SHEET TRANSFER MECHANSIM

The sheet transfer mechanism 10, hereinbefore briefly described, includes drive wheels 12*a* and 12*b* connected to an axle 13 adjacent the feeder 2 of the printing press and idler wheels 14*a* and 14*b* rotatably secured about an axle 15 adjacent sheet delivery mechanism 22. Band 16*a*, adjacent the operator side of the printing press, extends around wheels 12a and 14a, while band 16b, adjacent the drive side of the press, extends about wheels 12b and 14b. As will be hereinafter more fully explained, axle 13 is driven and traction between the surfaces of wheels 12a and 12b and bands 16a and 16b, respectively, imparts motion to the bands.

The conveyor system 10 is a mechanical device that carries the sheet 5 through the printing press 1. For proper printing to occur, the conveyor system 10 must offer mechanical repeatability of the sheet relative to each printing tower 18 and 20.

The bands 16a and 16b have been formed with good results from a strip of steel material 3.500 inches wide and 0.042 inch thick to provide a cross-sectional area of 0.147 square inches for each band. The band material is preferably a 1095 carbon steel, heat treated to a hardness of Rockwell C 47 and has a modulus of elasticity of $30\times10^6$ pounds per square inch.

Opposite ends of each of the strips of material are joined together by a riveted aircraft-type splice joint consisting of two plates, one being 0.020 inch thick and the other being 0.035 inch thick secured by flat-head hi-shear rivets extending through countersunk holes in the band to opposite sides of the band. The thinner plate will deflect before the thicker plate for distributing the load and the tension in the band to the rivets in a uniform manner to enhance the fatigue life of the joint.

Outer peripheries of wheels 12a, 12b, 14a and 14b are of substantially identical construction, each having a flange 11 secured to opposite sides thereof to form a groove into which tapes 16 extend. Flanges 11 merely prevent lateral movement of tapes 16 relative to wheels 12 and 14.

Figure 8:
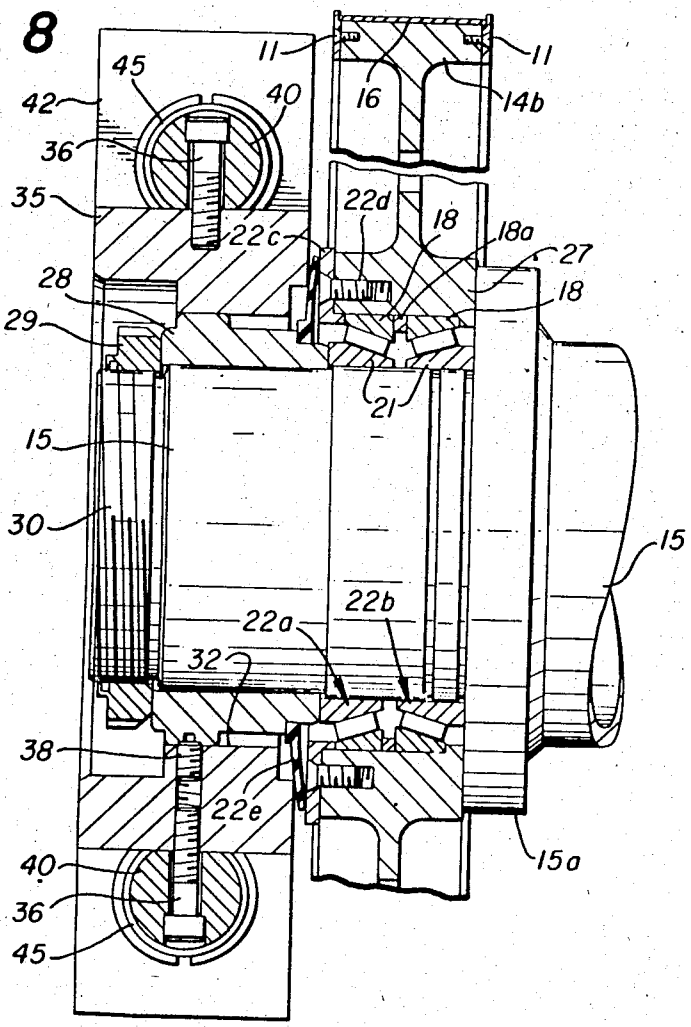
FIG. 8 is cross-sectional view taken along line 8—8 of FIG. 7.
Figure 10:
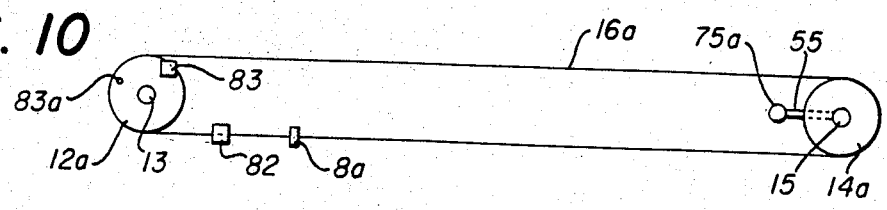
FIG. 10 is a diagrammatic section of the operator side of the conveyor system.
Figure 11:
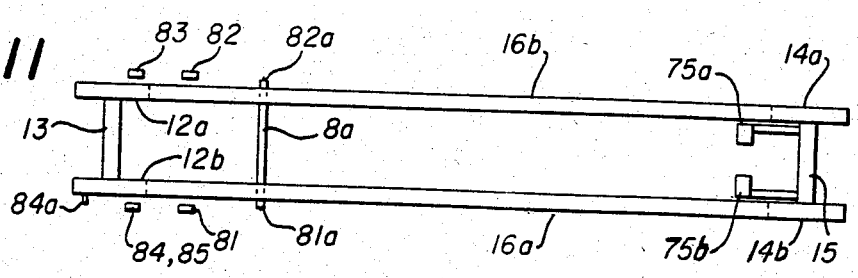
FIG. 11 is a diagrammatic top plan view of the conveyor system.
Figure 12:
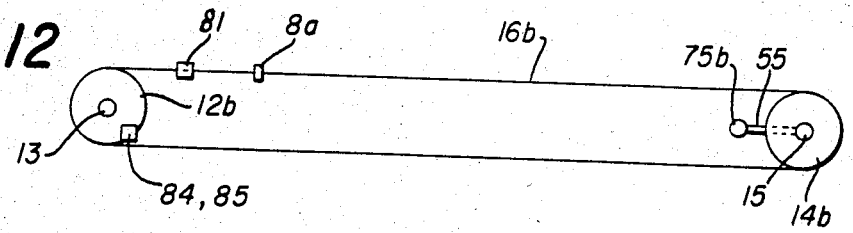
FIG. 12 is a diagrammatic elevational view of the gear side of the conveyor system.

As best illustrated in FIG. 8, wheels 14 at the delivery end of the printing press are freely rotatable about the non-rotatable axle 15 and have an inner hub 27 having a passage formed therethrough to receive the outer races 18 of bearings 22a and 22b. The inner races 21 of each of the bearings 22a and 22b are secured to axle 15. Each axle 15 has a hub 15a for restraining bearings 22a and 22b against inward movement on axle 15.

A retainer sleeve 28 extends around the outer end of axle 15 and engages the inner race 21 of the outer bearing 22a. Sleeve 28 is captured by a lock nut 29 threadedly secured to the outer end of a journal 30 on the outer extremity of axle 15.

Sleeve 28 extends through and is secured in an opening 32 formed in bearing block 35 which is secured by bolts 36 to support pins 40.

To assure that sleeve 28 and bearing block 35 are laterally secured together and located in a precise relationship relative to each other, a single set screw 38 is provided on one side of the press only.

Brackets 42 and 44 have spaced aligned apertures formed therein in which bearings 43 and 45 are secured. Opposite ends of support pins 40 are slidably secured in bearings 43 and 45 to permit movement of bearing block 35 and shaft 15. Brackets 42 and 45 are secured by belts 46 to side frames 22a and 22b of delivery station 22.

As illustrated in FIG. 8, a bearing retainer disc 22c is secured by screws 22d to tape wheel 14b for restraining the outer race 18 of bearing 22a against outer movement. A grease seal 22e is urged into sealing relation with bearing disc 22c and sleeve 28 to retain lubricating oil adjacent to bearings 22a and 22b. The inner races 21 of bearings 22a and 22b are pre-loaded relative to outer races 18 by adjusting nut 29 and the outer races are separated by spacer 18a.

Figure 9:
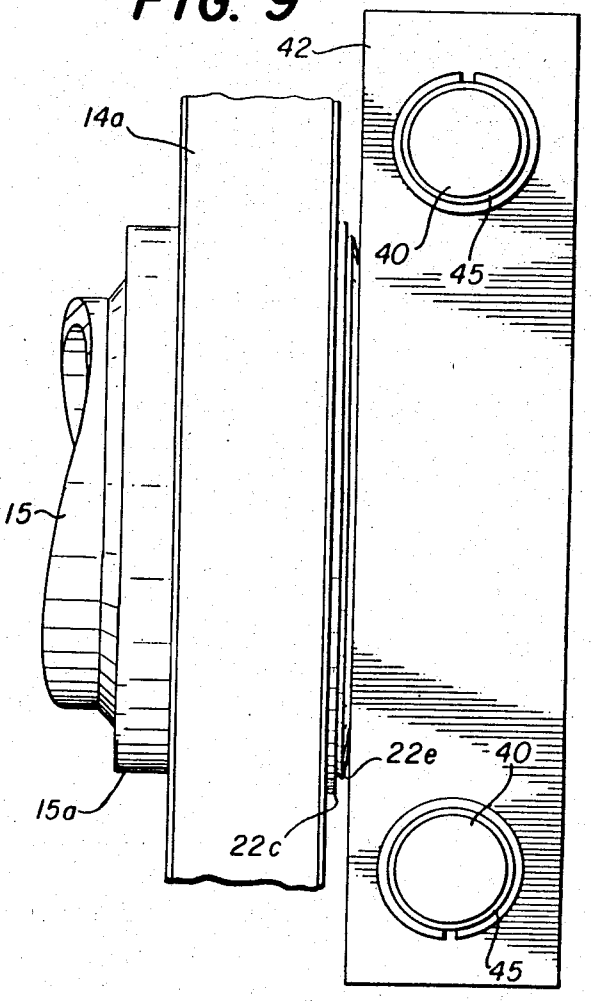
FIG. 9 is an elevational view looking in the direction of arrows 9—9 in FIG. 7.

Drive wheel 14a is similarly mounted on the opposite end of axle 15, as illustrated in FIG. 9. Each wheel is therefore independently adjustable and rotatable relative to the other.

Figure 7:
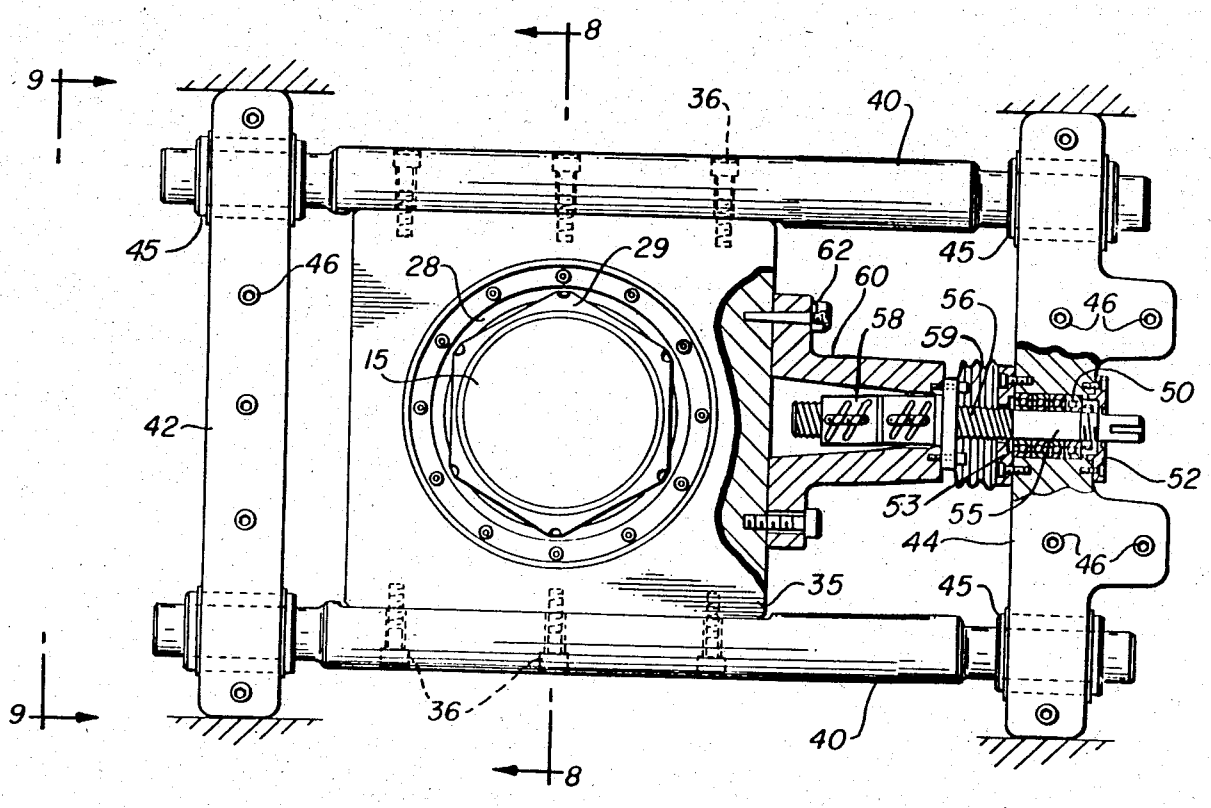
FIG. 7 is an enlarged cross-sectional view taken along line 7—7 of FIG. 2.

Referring to FIG. 7 of the drawing, it will be noted that bracket 44 has an aperture formed in a central portion thereof in which a bearing 50 is secured between lock plates 52 and 53 to prevent longitudinal movement of drive screw 55 relative to bracket 44. Drive screw 55 is of conventional design and has a ball screw portion 56 formed on the inner end thereof.

A ball nut 58 is secured by screws 59 to member 60 which is in turn secured by screws 62 to bearing block 35.

The ball screw 56 and ball nut 58 are of conventional design and are available from Saginaw Steering Gear Division of General Motors Corporation, Actuator Products Group, Saginaw, Mich. The ball bearing screw is a force and motion transfer device belonging to the family of power transmission screws. It replaces the sliding friction of the conventional power screw with the rolling friction of ball bearings. The ball bearings circulate in hardened steel races formed by concave helical grooves in the screw and nut. All reactive loads between the screw and nut are carried by the bearing balls which provide the only physical contact between the members. As the screw and nut rotate relative to each other, the bearing balls are diverted from one end and carried by ball guide return tubes to the opposite end of the ball nut. This recirculation permits unrestricted travel of the nut in relation to the screw.

From the foregoing it should be readily apparent that rotation of drive screw 55 imparts longitudinal movement through ball nut 58 to bearing block 35 thereby moving axle 15 in a horizontal direction relative to axle 13 at the opposite end of the printing press.

It should be readily apparent that wheels 14a and 14b are freely and independently rotatable about axle 15 and independentally horizontally adjustable in relation to each other. In the illustrated embodiment, wheels 14a and 14b are not driven except by bands 16a and 16b, respectively. However, it is contemplated that under certain operating conditions, wheels 14a and 14b could be equipped with auxillary motors and equipped with an overriding clutch and a braking system to facilitate rapid acceleration and deceleration of wheels 14a and 14b while minimizing the transmission of shock and dynamic loading to bands 16a and 16b. It should be appreciated that idler wheels 14a and 14b could be mounted on separate stub-shafts if it were deemed expedient to do so.

Drive wheels 12a and 12b adjacent the feeder end of the printing press are rigidly secured to axle 13 which is rotatably secured to feeder side frames 2a and 2b. A gear 66, secured to the end of axle 13, is driven by a line shaft 67 which drives gear trains 68 and 69 connected to plate cylinders and blanket cylinders in printing towers 18 and 20. Line shaft 67 is driven by one or more motors 70 connected through suitable gear trains. V-belts and sleaves, and gear boxes for transmitting the speed and driving force required for driving the printing towers and the conveyor system.

It will be readily apparent that the printing cylinders 48U and 48L and drive wheels 12a and 12b are driven at constant speed ratios through line shaft 67 and gears 66 and 68.

Referring to FIGS. 1, 2 and 7, drive screw 55 on the gear side of the printing press is driven by a remotely controlled stepper motor 75a and drive screw 55 on the operator side of the press is driven by a remotely controlled stepper motor 75b. Stepper motors 75a and 75b are of conventional design and are commercially available under the trademark "SLO-SYN" D.C. Stepper Motor, manufactured by The Superior Electric Company of Bristol, Conn. A suitable gear reducer, such as an "Ohio 20:1" worm gear, right angle drive 75c is preferably mounted between the stepper motors 75a and 75b and each of the drive screws 55 to attain a desired angle of rotation of ball screw 56 for imparting a specified distance of movement to bearing block 35 upon each step of the stepper motor.

Stepper motor 75a and 75b are employed for moving the slide blocks 35 at the delivery end of the press for moving the non-driven wheels 14a and 14b which are independently rotatable and independentally horizontally adjustable.

Although the unit of movement for each step of bearing block 35 is adjustable as deemed expedient, good results has been obtained by selecting a stepper motor having 200 steps per revolution connected through a 20:1 ratio gear reducer to drive screw 55. Drive screw 55 rotates ball screw 56 which has a 0.200 inch per revolution lead. Thus, one step of stepper motor 75a or 75b changes the distance between axes of axles 13 and 15 a distance of 0.00005 inches. The resulting change in length of band 16a or 16b is 2 times the change in the distance between the axes or 0.0001 inch per step of the stepper motor.

It will be readily apparent that each of the idler wheels 14a and 14b is equipped with a separate stepper motor to permit adjustment of the distance between the axes of wheels 12a and 14a independently of the adjustment of the distance between the axes of wheels 12b and 14b. Thus, the length of bands 16a and 16b are independently adjustable.

Initial band tension has been chosen to be 1,800 pounds in each band. This tension is achieved by manufacturing the individual bands to a length shorter than the desired installed length. Each band is elongated during installation to the desired length. As hereinbefore described, the distance between the axes of wheels 12a and 14a is adjustable to deflect the band to the final length.

A conveyor system which has been constructed for testing employed wheels 12a, 12b, 14a, and 14b having a diameter of 47.958 inches plus the thickness of the band which was 0.042 inch and thus provided a nominal pitch line diameter of 48.000 inches. The length of band driven by each drive wheel 12a and 12b during one revolution is 48.000 inches times $\pi$. This figure is approximately 150.7963 inches. The design ratio of the diameter of the conveyor drive wheels 12a and 12b to the diameter of the sixteen inch printing cylinders 38U and 38L was 3:1 while the ratio of the drive wheel to a 24 gripper bar system is 8:1. Multiplying 150.7963 by 8 gives 1206.3705 inches for the nominal final length of the band. The manufactured length of the band to achieve a 1,800 pound pre-load on the band, was 25.1227 times 48 which equals 1205.8883 or a total of 0.4922 inches shorter than the installed length of the band. Using the equation in which $\Delta = PL/AE$, where $\Delta$ equals 0.4922, L equals 1206.3705 inches, $A = 0.042 \times 3.5$ square inches and $E = 30 \times 10^6$ pounds per square inch; a load of P is equal to 1800 pounds.

Since the final length of the band is a function of the diameter of the driven wheel 12a and 12b, it can be seen that no two wheels can be made and maintained precisely identical diameter or that the length of the band driven thereby of precisely identical length established by the distance between drive & idler wheels, for moving gripper bars 8 through the printing press. Further, the idler wheels 14a and 14b cannot be made exactly the same diameter as drive wheels 12a and 12b. Therefore, no two pairs or two systems of bands and wheels can perform identically in practice. Therefore, idler wheels 14a and 14b are mounted to rotate independently of each other at the delivery end of the press.

Fixed band lengths can therefore work only on fixed dimensions of wheels & center distances therebetween which cannot be manufactured and/or maintained.

Axle 13 at the feeder end of the press is driven, as hereinbefore described and axle 13 is secured to maintain axle 15 in an established position. This is desirable because swing grippers 16 must register with the conveyor 10 for feeding sheets to the sheet conveyor. Thus, by maintaining driven axle 13 in a fixed position, register can be established and maintained between feeder 2 and conveyor 10. Further, since opposite ends of axle 15 can be moved independently by stepper motors 75a and 75b, axle 15 may not be maintained in a precisely aligned parallel relationship to driven axle 13.

Drive wheels 12a and 12b are rigidly secured to drive axle 13 to maintain the timing of band 16a relative to band 16b. However, the timing of the idler wheels 14a and 14b relative to each other is a variable that is unpredictable. Therefore, in the illustrated embodiment, the two idler wheels 14a and 14b are allowed to rotate freely and independently of each other since their speed of revolution will vary according to the actual diameter of the respective wheels.

As hereinbefore described, the main function of the conveyor system is to afford repeatability of the sheet relative to each printing tower 18 and 20. Mechanical repeat of conveyor bands 16a and 16b relative to drive wheels 12a and 12b occurs every eight revolutions of the drive wheels. Therefore, the length of the band is 8 times the theoretical circumference of drive wheels 12a and 12b.

Assuming that the length of the band 16a or 16b is not equal to exactly eight times the circumference of drive wheels 12a and 12b, then the mechanical repeat every eight revolutions of drive wheels 12a and 12b would not exist. With each cycle of bands 16a and 16b, an error will be noticed in the repeat of drive wheels 12a and 12b relative to the bands 16a and 16b. If this error is monitored, it will be seen that the error will accumulate with each cycle as a function of the error in the center distance between axes of axles 13 and 15 or the error in the length of the band. The actual function of repeatability to center distance error is: error equals two times the center distance error. For example, if the center distance is 0.001 inches more or less than it should be, after one complete revolution, the error repeat of the band and the drive wheel will be 0.002 inches. An initial position error could also exist with the band mounting on the wheel. In other words, the band could be initially misplaced relative to the wheels 12a or 12b even though the distance between axes of axles 13 and 15 is proper. In this instance, the error should not accumulate with each revolution of the drive wheel but would remain constant. Therefore, a monitoring system that would read this error and determine if accumulation existed or if the error was merely a position error would not only have to prevent further accumulation beyond certain limits but reposition the conveyor system relative to the dirve wheel to maintain a zero position error and register with the printing cylinders.

The position of conveyor bands 16a and 16b relative to the drive wheels 12a and 12b is critical because the bands move the gripper bars 8 relative to printing cylinders 38U and 38L.

The initial 1,800 pound tension in bands 16a and 16b is established and maintained for two reasons. First, to insure the tractive capability of the band and wheel arrangement such that no slippage will occur between drive wheels 12a and 12b and bands 16a and 16b. The tractive force is a function of the co-efficient of friction times the force normal to the surface of the drive wheels 12a and 12b. Second, tension in bands 16a and 16b is required to prevent a loss of tension or frictional driving force during normal thermal build-up of the conveyor system under normal operating conditions. Assuming, for instance, that the conveyor bands 16a and 16b were manufactured at an ambient temperature of 72° F., at a length of 1205.8883 inches and assuming that the band expands $6\times10^{-6}$ inches per inch of length per degree Fahrenheit; then one could assume that manufactured length of 1205.8883 inches, upon a temperature rise of 20° from 72° F. to 92° F. would result in an expansion of the length of the conveyor band 16a or 16b by 0.1447 inches. A reduction in tension would result equal to the difference between 1,800 pounds at 0.4922 inches deflection and 1273.185 pounds at 0.3482 inches deflection. Although the length of the mounted band 16a and 16b would not change because tension is still being maintained in the band, the tension would drop to 1,273.185 pounds as a result of the increase in ambient temperature. It should be noted that the band would not change in length until the tension actually dropped to zero pounds, then it would begin to expand in length.

REGISTER COMPUTER AND CONTROL

Referring to FIGS. 10, 11, 12 and 13, conveyor bands 16a and 16b are diagrammatically illustrated in relation to a computer for determining errors in locating of bands 16a and 16b relative to printing cylinders and for making adjustment of the lengths of the bands 16a and 16b for elimination of any error.

As hereinbefore explained, stepping motors 75a and 75b are mounted on the delivery end of the printing press for moving idler wheels 14a and 14b relative to drive wheels 12a and 12b.

Photocells 81, 82, 83, 84 and 85 are photoelectric cells particularly adapted to generate signals when a light beam is broken.

The location of the photoelectric cells 81–85 is optional provided that they are positioned to accomplish the function as set forth hereinafter.

Photocell 81 is positioned adjacent the gear side of the press such that a pin 81a on gripper bar 8a breaks the light beam.

Photocell 82 is positioned adjacent the operator side of the press and is positioned such that pin 82a on the end of gripper bar 8a breaks the light beam.

Photocell 83 is secured to the side frame 2a on the operator side of the press and the light beam is broken by pin 83a secured to drive wheel 12a.

Photocells 84 and 85 are secured to the side frame 2b on the gear side of the press and are spaced apart such that pin 84a on drive wheel 12b sequentially breaks the light beams of photocells 84 and 85.

Figure 13:
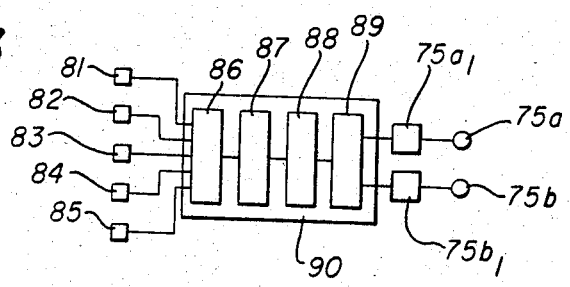
FIG. 13 is a diagrammatic view of the register computer.
Figure 16:
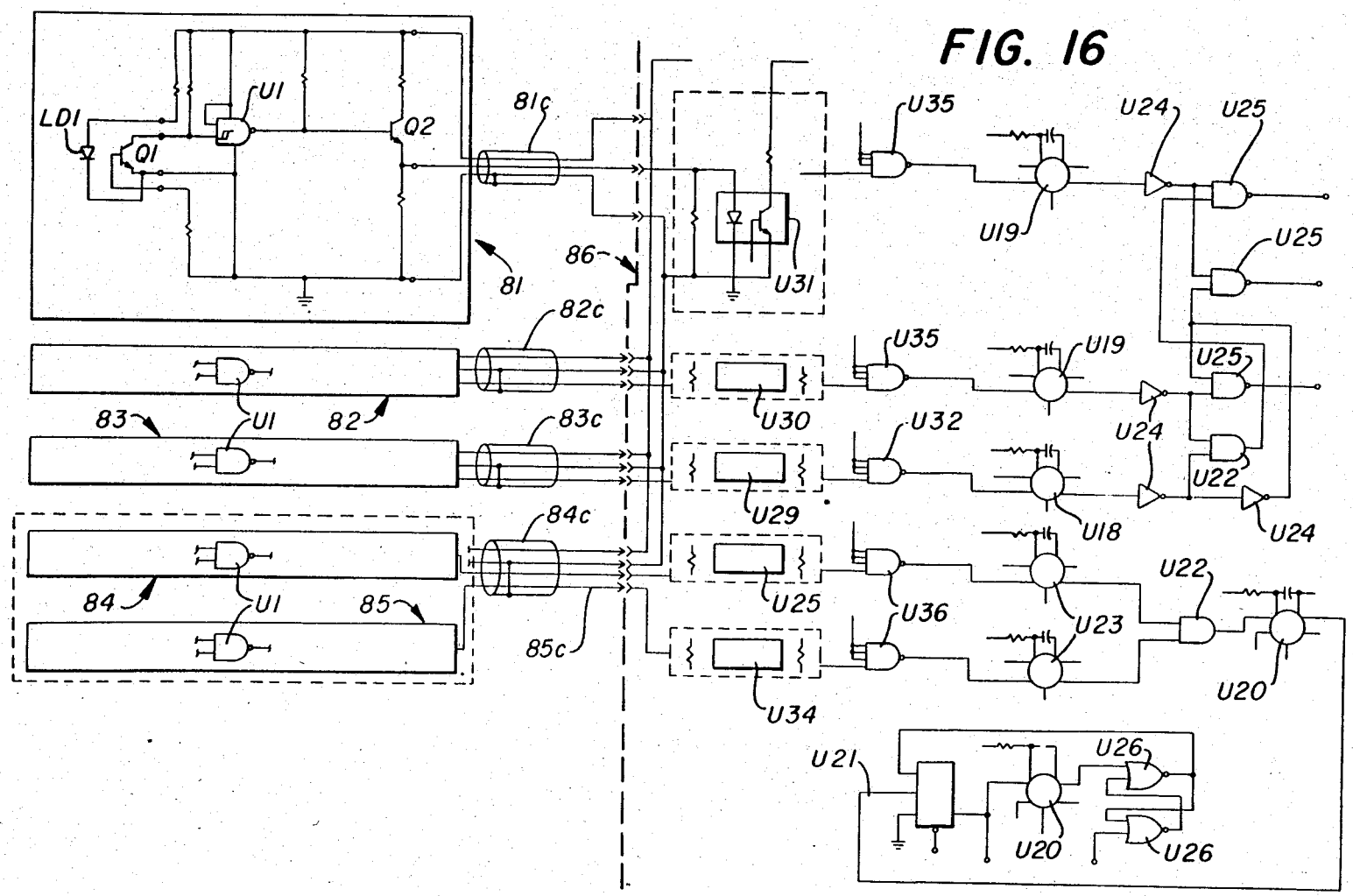
FIG. 16 is a wiring diagram of the registration computer interface.

As illustrated in FIGS. 13 and 16, signals from photocells 81–85 are delivered through cables 81c–85c to interface or input logic circuitry 86 for modifying the pulses from the photocells to a number which the computer can use. Signals from input logic interface board 86 are delivered through a commercially available interface module board 87, to a microcomputer 88, to an interface module 89, to motor controllers 75a and 75b. A commercially available power supply 90 is illustrated in combination with the circuitry as will be hereinafter more fully explained.

The interface module 87 and interface module 89 are commercially available from Motorola, Inc., of Phoenix, Ariz., and are designated "MEX68USM Universal Support Module" which is described in "User's Guide, First Edition, dated 1978." The Motorola User's Guide is incorporated herein by reference in its entirety.

The microcomputer 88 is commercially available from Motorola, Inc., of Phoenix, Ariz., and is referred to as "M68MM01, Monoboard Microcomputer 1, Micromodule 1," The microcomputer is described in User's Guide MM6801(D) dated Nov. 1, 1977, which is incorporated herein by reference in its entirety.

The power supply 90 is commercially available as a "Motorola M68SC with power supply," from Motorola, Inc., of Phoenix, Ariz.

The motor controllers 75a and 75b are available from the Superior Electric Company of Bristol, Conn., as a "Slo-Syn, Preset Indexer Module, Type PIM 153" equipped with a "Slo-Syn, Power Supply, Type MPS 3000." These components are described in Instruction Sheets SE-147816 (MS 2105 G223) and SE-1127937K (MS 2105 G226) which are incorporated herein.

Figure 15:
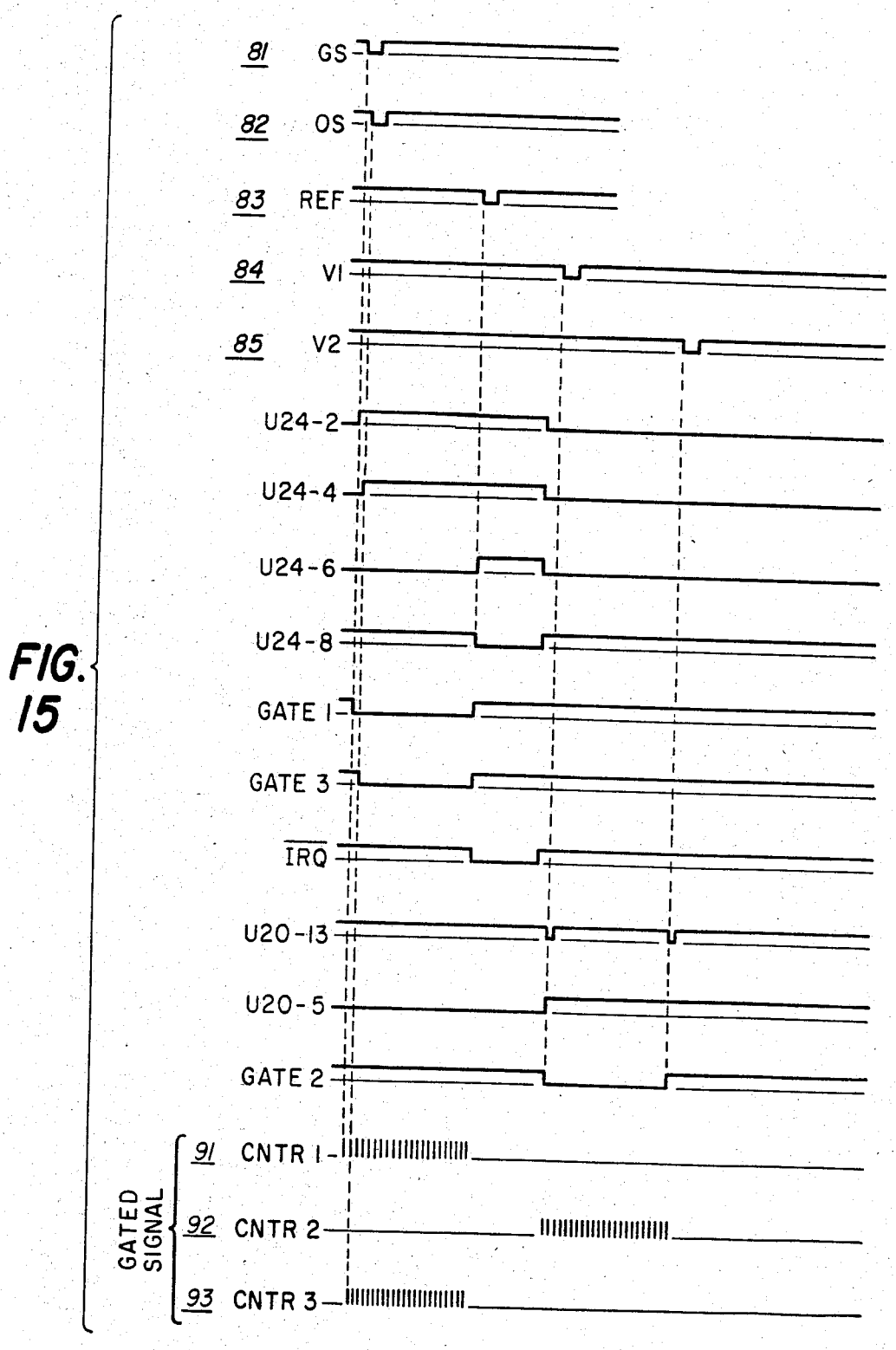
FIG. 15 is a series of bar graphs indicating time on the horizontal scale.

FIG. 15 is a series of bar graphs indicating time on the horizontal scale to form a timing chart to diagrammatically illustrate operation of the photocells 81–85 and the input to the computer. The time sequence of the various signals is indicated adjacent the numeral reference at the left-hand side of the chart corresponding to the respective photocells.

Figure 17:
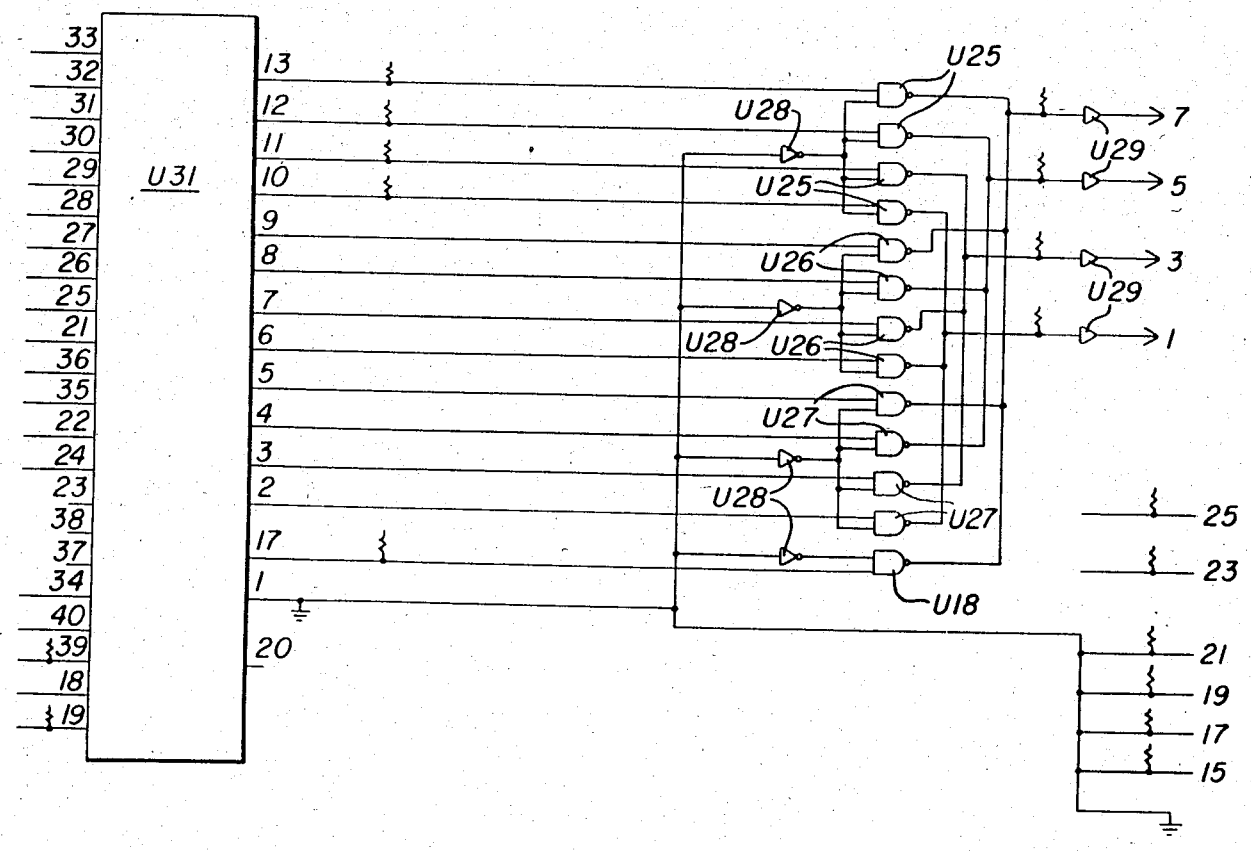
FIG. 17 is a wiring diagram of the motor controller.

The elements incorporated into FIGS. 16 and 17 of the drawings and referred to in FIG. 15 include: photocells 81, 82, 83, 84 and 85; NAND gate U1 with Schmidt trigger input; optical couplers U28, U29, U30 and U31; NAND gates U25, U32, U35 and U36; one-shots U18; U19; U20 and U23; inverter buffers U24; AND gates U22; NOR gate U26 connected as a flip-flop; J–K flip-flop U21; amplifier Q2 in FIG. 16; and in FIG. 17, buffer U29; inverter buffer U28; NAND gate U18, U25, U26, and U27; and periphial innerface adapter PIA.

As illustrated in FIG. 15, the first thing that occurs in this system is that a pulse is delivered from one of the photocells 81 or 82 triggered by movement of gripper bar 8 carried by bands 16a and 16b when a pin 81a or 82a on the end of the gripper bar breaks the light beam. The exact time at which pins 81a and 82a trigger photocells 81 and 82 will be dependent upon the position of the respective bands 16a and 16b. If bands 16a and 16b are precisely positioned in the desired, registered relationship, photocells 81 and 82 will be triggered simultaneously.

Photocells 81 and 82 indicate the positions of bands 16a and 16b relative to the member carrying pin 83a which triggers photocell 83. It will be noted that, although pin 83a is secured to drive wheel 82, it may be secured directly to printing cylinders 48U or 48L if it is deemed expedient to do so. However, in the illustrated embodiment, the surface speed of drive wheel 12a is synchronized to the surface speed of the printing cylinders 48U and 48L and thus pin 83a is moving in a known relationship to the surface speed of the printing cylinders. Reference pin 83a could also be located on drive shaft 67, on a drive gear or some other part of the press having a known speed relationship relative to the printing cylinders.

Photocells 84 and 85 are mounted such that the distance between the light beams of the respective cells is precisely known, for example, 0.314 inches to generate a velocity reference. It will be appreciated that selection of the distance between photocells 84 and 85 is arbitrary. However, the distance moved by pin 84a for triggering photocells 84 and 85 should be the same as the distance pin 83a on drive wheel 12a moves after pin 82a or pin 81a triggers photocells 81 or 82.

The photocells are arranged to measure the time between the breaking of a light beams in the respective photocells. By indicating the time sequence of the relative positions of the parts the actual distance between the parts can be computed. However, signals must be generated to indicate numbers with which the computer can work, so the input circuitry gives the computer a number and with the components illustrated in FIG. 4 correlated with the timing chart illustrated in FIG. 5 signals can be generated for stepping motors 75a and 75b for adjusting the time interval for triggering photocells 81–85 as desired.

Referring to FIG. 15, it will be noted that the first thing which has happened is that pin 81a on gripper bar 8a has broken the light beam in photocell 81 which has resulted in the generation of a pulse from a one-short circuit that produces an output signal of fixed duration, when an input signal of any duration is applied, which is delivered to logic circuitry. The logic circuitry is set up to open counter gate when the band signal occurs and the gate stays open until the reference signal from photocell 83 is received. The gate opens the input to the counter and allows a one megahertz crystal controlled signal from the computer to pass through the gate to the counter so that the gate counts cycles of the one megahertz signal from the time between the band pulse, when photocell 81 was triggered, until the reference pulse from photocell 83 is received.

It will be noted that two counters are employed, a first counter 91 counting for the gear side of the press and a third 93 for the operator side of the press. The same thing occurs, but later, usually following this sequence for the speed reference. Pin 84 on drive wheel 12b on the gear side of the press passes through photocell 84 and triggers the gate open to the second counter 92 and the pin moves the known distance of 0.314 inches before it passes through photocell 85 and closes the gate to the second counter 92. The three counters 91, 92, and 93 are in one intergrated circuit chip, for example, an integrated circuit chip known as a Motorola 6840, Programable Timer Module which will interface directly with computers.

The count from the first, second and third counters are the numbers with which the computer works. The count again is based upon a one megahertz signal ($1\times10^6$ cycles per second) so that the number diagrammatically illustrated in the last three lines of FIG. 15 of the drawing represents the number of one millionths of seconds that it takes for the pin to pass from one photocell to the other. The second counter 92 indicates the time that it takes for the press to move the known distance of 0.314 inches, and the count on the first and third counters indicates the time that it took for the bands 16a and 16b to move the actual distance travelled by the band during the time interval.

As noted hereinbefore, the distance between photocells 84 and 85 was arbitrarily selected to be 0.314 inches and this distance could be, for example, 2 inches or any other arbitrary figure, so long as the distance is known.

Upon receiveing the count from Counters 91, 92 and 93 the computer determines the "error distance". First, the computer must know the velocity of the press. It is known that velocity is equal to distance divided by time. Since photocells 84 and 85 are positioned 0.314 inches apart, substituting this number into the equation along with the count in counter 92, which is the time in micro-seconds that it took the press to pass between photocells 84 and 85, the velocity of the press can be determined.

To determine the position of band 16b on the gear side of the press, the count in counter 91 indicates time and the velocity of the band is equal to the velocity of the drive wheel, since there is no slippage between the band and the drive wheel. Solving the equation should give the distance between pin 81a on gripper bar 8a and pin 83 on the drive wheel 12a in inches.

If the distance is correct, the band length or position is 0.314 inches and it will pass through in the same amount of time that it takes the pin 84a to pass through photocells 84 and 85 which is also 0.314 inches. If the count in counter 92 is subtracted from the count in counter 91, the difference is equal to the error expressed in time. To determine the distance of the error, the time of the error signal can be substituted into the following "Equation A":

$$E = \left(\frac{C2 - C1}{C2}\right) \times 0.314 \times 10^4$$

E=Error Dist
C2=Count in Counter 92
C1=Count in Counter 91

Solving this "Equation A" gives the actual error distance in inches. Since corrections are made by the stepper motors in increments of 0.1 thousandths of an inch, the number has been multiplied by 10,000 to get the number of steps of corrections that will be required.

The computer is programmed to solve the following "Equation B" to make an adjustment in the length of bands 16a and 16b:

$$A = \left(\frac{E}{2}\right) + (E - LE).$$

A=Adjustment
E=Error Distance
LE=Last Error Dist

Figure 14:
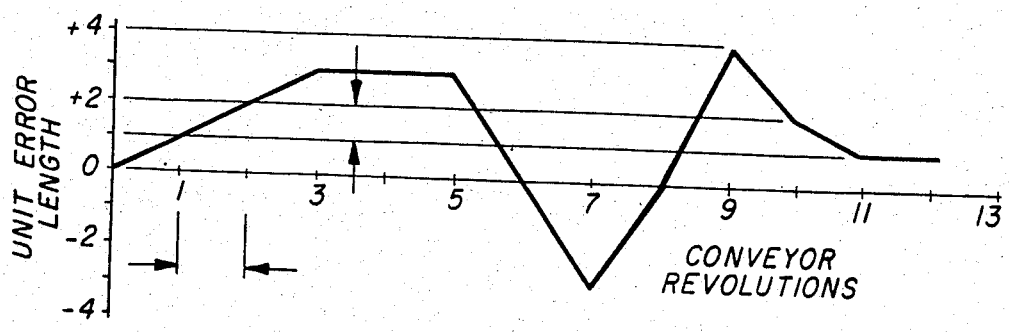
FIG. 14 is a graphic illustration upon which conveyor revolutions are plotted as the abscissa and on which the band position error, expressed in units of length, are plotted as the ordinate.

FIG. 14 of the drawing is a graphic illustration upon which conveyor revolutions are plotted as the abscissa and upon which the band position error, expressed in units of length, are plotted as the ordinate. The ordinate is expressed in arbitrary units of distance. However, it is convenient to select the units of distance corresponding to one step of the stepping motors 75a and 75b.

In FIG. 14 the graph indicates that the press was started with the band in the proper position (coordinate 0,0). After running one revolution, the band was out of position by one unit or 0.0001 inch (coordinate 1,1) which means that the band was the wrong length. In forming the graph illustrated in FIG. 14 a plus adjustment of length should increase the band length and a minus adjustment should shorten the band length. Since the conveyor was out of register by one unit after one revolution of the conveyor, it would be out of register two units after two revolutions if no adjustment were made. Referring to the curve, the amount of the position change from one revolution to another, it will be seen that the error length of the band would be determined by measuring the band position between one revolution and the next. In other words, if the position of the band changes by one unit per revolution it is a one unit error. If after getting out of position, the length of the band is made to be exactly right, it would then repeat, but it would repeat at the same position error as indicated between revolutions 3 and 5 on the graph where an error of 3 units was maintained.

Referring to the curve in FIG. 14 at revolution 5 of the conveyor, it will be noted that the length of the band was increased by about 3 units and the curve shows that after one revolution, it would have moved to the correct position. After getting back to the correct position, if no further changes were made, the position error would be off by 3 units in the other direction upon completion of the next cycle as indicated at the beginning of revolution 7.

It should be noted that there are two types of error, the position error and a length error. The length error can cause the position error to be "positive going" or "negative going" and it does not really matter what the position error is since the length error is independent of it. For example, between revolution zero and revolution one in FIG. 14, the position error is positive and it is a "positive going" position error. The "positive going" position error indicates that the band is too short. Between revolutions 7 and 8, the "positive going" position error indicates that the band is stillshort; however, the position error at this time is negative rather than positive. Between revolutions 8 and 9, the graph indicates that an adjustment was made which resulted in the position error being four units at the beginning of the ninth revolution.

Beginning with the ninth revolution, the graph indicates what happens when the computer makes adjustments from "Equation B" above. The equation accounts for both errors, the position error and the length error, and combines two different adjustments into one adjustment to actually change the band length. First it adjusts for the actual position error. At the ninth revolution, the position error is plus four units and it has been determined that this error should be decreased by one-half so the adjustment is $E \div 2$ or $4 \div 2 = 2$. The change that occured during the last revolution must be considered to determine what the length error actually is. At the beginning of the eighth revolution, the position error was zero and at the beginning of the ninth revolution the position error was plus four units, which means that the length error was plus four units. The "E-LE" portion of the equation would give a plus four added to a plus two to give a plus six. The band was short, which caused the "positive going" error between the eighth and ninth revolutions, and making a positive adjustment would increase the band length by four units of the six units which would nullify the error that existed between the eighth and ninth revolutions. The additional 2 units would cause it to be "negative going" to a position error of two units so that at the beginning of the tenth revolution, the actual position error would be a plus 2 units. Thus, the plus 4 that existed at the ninth revolution, the plus 2 that existed at the tenth revolution inserted into the adjustment equation indicates that the adjustment is a negative 1 unit. In other words, it shortened the band by one unit. The band was two units long at the beginning of the tenth revolution. Shortening the band one unit leaves it one unit too long and from the tenth revolution to the eleventh revolution the position would change by one unit, down to one. From the eleventh to the twelveth revolution, after making the adjustment, the band actually would be the right length and it would stay the one unit off of zero because adjustments of less than one unit cannot be made by the stepper motors.

Referring to the example above, it will be noted that solving the equation indicates that the position error will be reduced by one-half, so that adjustments are made in increments to bring the bands back one-half of the error upon each adjustment. Referring again to FIG. 14, it must be appreciated that adjustments between the first and the beginning of the ninth revolution are not made in accordance with "Equation B". Adjustments in accordance with "Equation B" were made at the beginning of the ninth revolution through the twelveth revolution.

It is not desirable to attempt to make adjustment to bring the bands all the way back into register in a single adjustment because the adjustments will tend to be excessive which will result in making the system oscillate. The more rapidly the system is brought back into register, the more it will tend to oscillate. The application of "Equation B" above tends to dampen out all other factors which minimizes oscillation. Further, if adjustments are made slower than one-half the error the response of the correction will be too slow. The adjustment of 0.5 of the error upon each revolution of the band is believed to be an optimum adjustment. However, it will be appreciated that an adjustment of 0.8 or 0.3 of error upon each revolution of the band will operate successfully; however, not as efficiently as the result which is required in making the 0.5 adjustment.

Referring to FIGS. 13 and 16 of the drawing, photocells 81–85 are identical. The structure photocell 81 is illustrated in FIG. 16.

Light from an infra red light emitting diode LD1 shines on a photo sensitive transistor Q-1 and pin 81*a* on gripper bar 8 passes between the diode LD1 and the transistor Q-1 breaking the light beam, which in turn causes the transistor Q-1 to conduct less. Decreasing conduction is converted to a voltage change across resistor R2 and the voltage change is felt at the input to a NAND gate U-1. In this case, a 74132 NAND gate has been used which has a Schmidt trigger input. The Schmidt trigger input switches at a definite voltage, for example, at 2.1 volts. A "negative going" signal triggers gate U-1 as it passes 2.1 volts. Thus, the output changes from high to low and low to high as the case may be. The Schmidt trigger U-1 effectively shortens the switching time of the photo sensitive transistor Q-1. The light beam is not blocked instantaneously, but it is blocked and it is most accurate when the voltage from the photo transistor is crossing the 2.1 volt area. So by triggering at that voltage, the definition of the position is increased. The output of the NAND gate U-1 is delivered through a simple transistor amplifier Q-2, a low impedance output amplifier, and through a cable 81c from the press to the actual computer location.

The low impedance output amplifier Q-2 driving a photo-coupler U31 in the computer is employed to reduce electrical interference from the press. The optical couplers U31 with the low impedance driver Q-2 in effect eliminate interference and the optical coupler is driving another Schmidt trigger input NAND gate U-35 to further eliminate interferance. The output of the Schmidt trigger U-35 is driving a one-shot U-19 which produces a pulse when it receives the signal trigger from the NAND gate. The pulse length from one-shot U-19 is determined by the external components to make the pulse from the photocell 81 of a constant length of 100 milli-seconds.

The actual pulse from the photocells 81–85 varies in length with the press speed, the slower the press is running, the longer the pulse. It would interfere with computer operations to switch off at the wrong time. By making the pulse a constant 100 milli-seconds, such problems have been eliminated.

Each photocell 81–85 delivers a signal through a Schmidt trigger and a one-shot. From there they drive logic circuitry U25. The logic is set up so that if a pulse is received from one of the bands 16a or 16b, either photocell 81 or 82, then the counter gate output IRQ at terminal K3-1 is held low.

Any pulse from photocell 81 will hold low true gate 1 of logic element U25 low. A pulse from photocell 82 will hold low true gate 3 of logic element 25 low. When these gates are low, or true while they are low, the counter 91 is counting the one Megahertz signal to the computer. They are held low until a pulse from photocell 83 triggers the one-shot U-18. That signal is inverted at U-24 and used to turn off the NAND gates that are producing the low true signal. Now, this is another use of the one hundred milliseconds pulses. The time that it takes for the 0.314 inches to pass on the press is less than one hundred milli-seconds and by holding these one-shots to one hundred milli-seconds or longer, the computer is given time to recognize the fact that there is a number there to read. The computer resets everything before the one-shots have gone back to their normal state.

Another portion of the logic circuit insures that when all three of these pulses occur simultaneously, then we have a low true high IRQ, which is a signal for the computer that an event has occurred and that the computer needs to do something. The IRQ actually means interrupt request. It interrupts the computer and requests that it do something with this information. The three signals occur to give that signal immediately following the signal from photocell 83. That signal closes the gate to the counters 91 and 93, which means that at that time counters 91 and 93 have the numbers to be used.

The computer will ignore the extra seven revolutions of wheels 12a and 12b. In other words, unless the pins 81a or 82a on gripper bar 8 carried by bands 16a and 16b trigger photocell 81 or 82, which only happens once per press revolution, the computer does nothing. The velocity signal has been generated eight times. However, it is used only the last time it was generated, so the computer is instructed to hold the velocity signal from photocells 84 and 85 in a reset state until readings from the bands are received. After getting an IRQ signal the computer becomes active and enables the velocity circuit by applying a signal to U-21, pin 1. This is actually the clear input to JK flip-flop U21 and the computer is holding it in the clear stage until it gets an interrupt request. It then removes the clear so that it can operate.

After removing the clear, the computer does nothing for approximately one hundred thousandths (0.1 sec.) of a second. When the velocity signal occurs, the pin 84a is positioned on the drive wheel 12b so that immediately following the pulse from photocell 83, the two pulses are received from photocells 84 and 85. By then, this circuit can operate.

Photocell 84 triggers one-shot U-23 which, in turn, provides the signal to the input pin 2 of an AND gate U22. If the input to AND gate U-22, at pins 1 and 2, is in the true state the output also would be high or true. The signal from photocell 84 turns this signal from terminal 2 of AND gate U-22 off so that the output is turned off.

Driving pin 2 of one-shot U20 is set for a very short time period, for example, six microseconds, so that pin 3 of AND gate of U-22 is turned off for six microseconds when we get a signal from photocell 94 and then is turned off again for six micro-seconds when we get a signal at photocell 85. That puts the signal from photocells 84 and 85 on one line out of AND gate U-22, but not at the same time, to one-shot U-20, pin 2, that has been adjusted to 0.7 milli-seconds. In effect, one-shot U-20 stretches the very short pulses into it, making them longer. This makes the pulse long enough to drive the following circuitry, but at the same time, it is short enough that the two pulses never interfere with one another. When the press is running at maximum speed, the two pulses are 1.8 milli-seconds apart so that spacing between the pulses at maximum speed is roughly equal to the pulse width.

These pulses drive the JK flip-flop U21. The first pulse triggers the flip-flop causing the not true output, pin 7, to go low and this output is coupled to gate 2 of the counter. The counter starts counting from the first pulse. It also triggers one-shot U20, which in turn, toggles a flip-flop U26 consisting of two sections. The output of this flip-flop U26 is fed back to the J input of the JK flip-flop U21, making it possible for the JK flip-flop U21, to turn off, but it cannot turn on again until flip-flop U26 has been reset. This makes it possible for the second pulse to turn the JK flip-flop U21 off, removing the signal from gate 2 of the counter.

When the second pulse counter is turned off, any noise or one revolution of the drive wheel which produces two more pulses, connot operate this circuit until the U20 is expired and the computer has output a reset signal to pin 6 of flip-flop U26. This occurs a minimum of 1.8 milliseconds and a maximum of 18 milli seconds. The computer was waiting one hundred milli-seconds for this to occur so that during a period of roughly eighty milli-seconds the circuit is not active. This gives the counters time to stabilize a little bit and stray capacitance has time to discharge and before the computer starts working.

After one hundred milli-seconds, the computer reads counters 91, 92 and 93 and starts processing the mathematics. When it finishes the mathematics, the computer outputs the adjustment to the motor controllers, outputs the reset to pin 6 of flip-flop U26, and then goes into a wait state.

The circuit and components shown in FIG. 17 is a conventional circuit which is commercially available from The Superior Electric Company of Bristol, Conn. and is described in a publication entitled "Instructions for Installation, Operation and Maintenance, SLO-SYN, Preset Indexer Module Type PIM 153" (SE—147816; MS2105G223) which is incorporated herein by reference in its entirety for all purposes.

Figure 4:
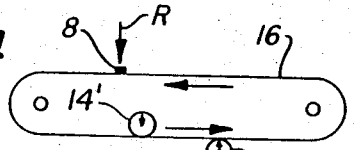
FIG. 4 is a diagrammatic view of a sheet conveyor which is properly registered.
Figure 5:
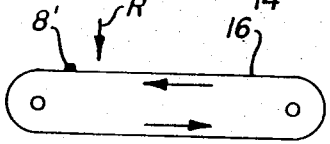
FIG. 5 is a diagrammatic view similar to FIG. 4 in which the path of the sheet conveyor is too short.
Figure 6:
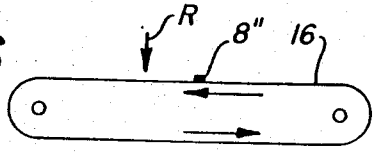
FIG. 6 is a diagrammatic view similar to FIG. 4 in which the length of the sheet conveyor is too long.

From the foregoing it should be apparent that when a gripper bar 8 carried by conveyor bands 16 is properly positioned relative to a reference point R, as illustrated in FIG. 4, the length of band is properly adjusted. However, if the band 16 is too short so that it arrives at the reference point R too early, as illustrated in FIG. 5, or is too short so that it arrives at the reference point R too late, as illustrated in FIG. 6; signals will be generated to energize actuator 75*a* or 75*b* to adjust the length of band 16 to restore the register condition illustrated in FIG. 4.

We claim:

1. An automatic sheet register control for a printing press comprising: a pair of printing cylinders, an endless sheet conveyor; means to drive the printing cylinders; means rotating said endless sheet conveyor through one revolution to move sheets adjacent said printing cylinders such that said sheet conveyor moves through one revolution per N revolutions of said printing cylinders; the improvement comprising: means to adjust the length of the endless sheet conveyor to cause sheets carried by the endless sheet conveyor to move to registered relation with the printing cylinders; first sensor means generating a signal related to the surface speed of the printing cylinder; second sensor means generating a signal related to the surface speed of the endless sheet conveyor; and a logic circuit delivering signals from the first and second sensor means to said means to adjust the length of the endless sheet conveyor, said logic circuit being adapted to determine the difference in the distance traveled by a reference point on said sheet conveyor relative to the distance traveled by a reference point on one of said printing cylinders in N revolutions to establish the error distance, compare the error distance with the error distance of an earlier revolution of the endless sheet conveyor, and cause the length of the endless sheet conveyor to be adjusted in an amount equal to approximately one half the error distance plus the difference between the error distance and the prior error distance.

2. The automatic sheet register control of claim 1, the endless sheet conveyor comprising: a feeder station; a delivery station; flexible conveyors movably extending along each side of the press from the feeder station to the delivery station; spaced elongated sheet engaging means extending between the flexible conveyors and movable from the feeder station to the delivery station, said sheet engaging means being adapted to engage a sheet at the feeder station and continuously convey same between the surfaces of the printing cylinders to the delivery station; means to secure the sheet engaging means to the flexible conveyors adjacent the ends of the sheet engaging means; and means to adjust the length of the flexible conveyors to change the frequency of the sheet engaging means relative to the frequency of the printing cylinders.

3. The automatic sheet register control of claim 1, said means to adjust the length of the endless conveyor comprising: wheels adjacent opposite ends of the printing press, said endless conveyor extending around said wheels; and means to adjust the distance between the axes of the wheels to change the time required to move a point on the endless conveyor through one complete revolution of the conveyor.

4. A method of positioning surfaces on a circular printing cylinder and an endless flexible extensible band in a precisely synchronized relationship, the printing cylinder being round and having a circumference of $\pi$ times the diameter of the printing cylinder establish rotating relative to a surface on the flexible extensible band, the flexible extensible band having a length of approximately N times the circumference of the circular printing cylinder the improvement comprising: suspending the endless flexible extensible band between a pair of spaced wheels rotating about spaced axes such that the band engages a portion of the circumference of each wheel; determining the time required to move a point on the circular printing cylinder through N complete revolutions to establish a reference point; determining the time required to move a point on the flexible band through a complete revolution; comparing the time difference between when the point on the band actually reached the reference point on the printing cylinder and when it should have reached the same reference point on the printing cylinder if the points on the band and on the printing cylinder were synchronized; comparing the time difference of an earlier cycle of rotation of the band with the time difference of the last cycle of rotation of the band; and adjusting the distance between the axes about which the wheels rotate in response to the variation between the earlier time difference and the last time difference to change the length of the flexible band to minimize the time difference.

* * * * *

UNITED STATES PATENT AND TRADEMARK OFFICE

CERTIFICATE OF CORRECTION

PATENT NO. : 4,567,824

DATED : February 4, 1986

INVENTOR(S) : Harold P. Dahlgren; John W. Gardiner; Jesse L. Lowdermilk

It is certified that error appears in the above-identified patent and that said Letters Patent is hereby corrected as shown below:

Col. 3, line 63, change "switch" to -- swing --

Col. 4, line 22, change "The", first occurrence, to -- Tie --

Col. 5, line 58, change "belts" to -- bolts --

Col. 9, line 31, change "and" to -- or --.

Signed and Sealed this

Sixteenth Day of December, 1986

*Attest:*

DONALD J. QUIGG

*Attesting Officer*

*Commissioner of Patents and Trademarks*